US005551118A

United States Patent [19]

Yeh

[11] Patent Number: 5,551,118

[45] Date of Patent: Sep. 3, 1996

[54] MACHINE FOR CLEANSING A PLAYBALL

[76] Inventor: Ding-Tsai Yeh, 364, Pon-Yi Road, Tai-Ping, Taichung, Taiwan

[21] Appl. No.: 493,987

[22] Filed: Jun. 23, 1995

[30] Foreign Application Priority Data

Oct. 17, 1994 [CN] China ..... 94243292.4

[51] Int. Cl.[6] ..... A63B 47/04

[52] U.S. Cl. ..... 15/302; 15/3.13; 15/21.2

[58] Field of Search ..... 15/3.12–3.14, 15/3.16, 3.19, 3.2, 3.21, 21.2, 302

[56] References Cited

U.S. PATENT DOCUMENTS

| | | | |
|---|---|---|---|
| 1,530,415 | 3/1925 | Roussel | 15/3.13 |
| 1,876,851 | 9/1932 | Burg | 15/21.2 |
| 2,005,115 | 6/1935 | Stutz | 15/21.2 |
| 2,178,185 | 10/1939 | Nicholson | 15/3.16 |
| 2,234,766 | 3/1941 | Kennedy et al. | 15/21.2 |
| 2,357,892 | 9/1944 | Grant | 15/3.2 |
| 2,627,140 | 2/1953 | Marzolf | 15/3.14 |
| 2,824,318 | 2/1958 | Marzolf | 15/3.13 |

FOREIGN PATENT DOCUMENTS

| | | | |
|---|---|---|---|
| 6-154362 | 6/1994 | Japan | 15/21.2 |
| 775039 | 5/1957 | United Kingdom | 15/3.13 |
| 2270474 | 3/1994 | United Kingdom | 15/21.2 |

*Primary Examiner*—Mark Spisich
*Attorney, Agent, or Firm*—Browdy and Neimark

[57] ABSTRACT

A playball cleansing machine comprises a cleansing member, a transporting member and a guide plate member. The cleansing member has a shaft provided peripherally with bristles. The transporting member is located under and parallel to the cleansing member and is provided with a rod having peripherally a spiral located along the longitudinal axis thereof for forming a spiral recessed rail. The guide plate member is provided with a lower plate having at the top thereof a shoulder plate extending upwards to form an upper plate for forming a transporting rail.

2 Claims, 8 Drawing Sheets

MACHINE FOR CLEANSING A PLAYBALL

FIELD OF THE INVENTION

The present invention relates generally to a playball cleansing machine, and more particularly to a playball cleansing maichine having an improved unit for transferring a playball and an improved unit for drying a cleansed ball.

BACKGROUND OF THE INVENTION

There are a variety of balls, such as baseball, football, tennis ball, ping-pong ball, volleyball, soft vacuum ball, etc. The soft vacuum ball is intended for use by kids in the playground for fun and is therefore prone to become dirty easily. In view of safeguarding the health of kids playing the vacuum ball, the ball should be kept clean all the time.

As shown in FIG. 1, a conventional machine for cleansing a vacuum playball is composed of a guide rail 11, two rotary wheels 13 and 14. The guide rail 11 is intended for carrying and transporting a plurality of vacuum playballs 12. Two rotary wheels 13 and 14 are located respectively on the left side and the right side of the guide rail 11. As the rotary wheels 13 and 14 are turned the vacuum playballs 12 are caused to rotate in the direction indicated by an arrow 121.

Such a prior art machine for cleansing a vacuum playball as described above is defective in design in that the rotary wheels 13 and 14 are not effective in causing the rotation of the vacuum playballs 12 which have a rather smooth ball surface, and that the vacuum playballs 12 are caused to rotate unidirectionally when they are being cleansed. As a result of the playballs 12 being rotated unidirectionally, the front side 122 and the rear side of the playballs 12 are often unclean at the conclusion of the cleansing process.

SUMMARY OF THE INVENTION

It is therefore the primary objective of the present invention to provide a vacuum playball cleansing machine with an improved unit for transferring a playball being cleansed, and with an improved unit for drying a playball which has been cleansed.

The foregoing objective of the present invention is attained by the vacuum playball cleansing machine, which comprises a cleansing member, a transporting member, and a guide plate member. The cleansing member has a shaft which is fastened pivotally at both ends thereof with a housing and is driven by a power source. The shaft is provided peripherally with a plurality of bristles arranged radially. The transporting member has a shaft rod which is located slightly under and parallel to the cleansing member and is fastened pivotally at both ends thereof with the housing. The shaft rod is driven by a power source and is provided peripherally with a spiral strip located along the longitudinal axis thereof for forming a spiral recessed rails. The guide plate member is located by the side of the transporting member and is provided with a lower plate having at the top thereof a shoulder plate extending upwards to form an upper plate so as to form a transporting rail.

The foregoing objective, features, functions and advantages of the present invention will be more readily understood upon a thoughtful deliberation of the following detailed description of the present invention in conjunction with the accompanying drawings.

DETAILED DESCRIPTION OF THE INVENTION

Figure 1:
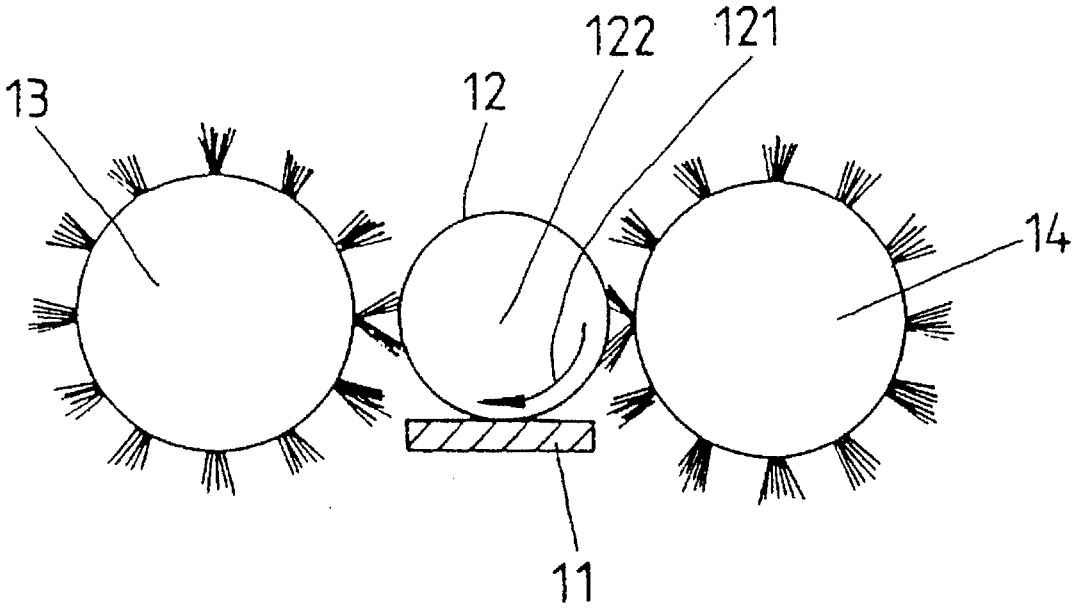
FIG.1 (PRIOR ART)
FIG. 1 shows a schematic view of a prior art machine for cleansing a playball.
Figure 2:
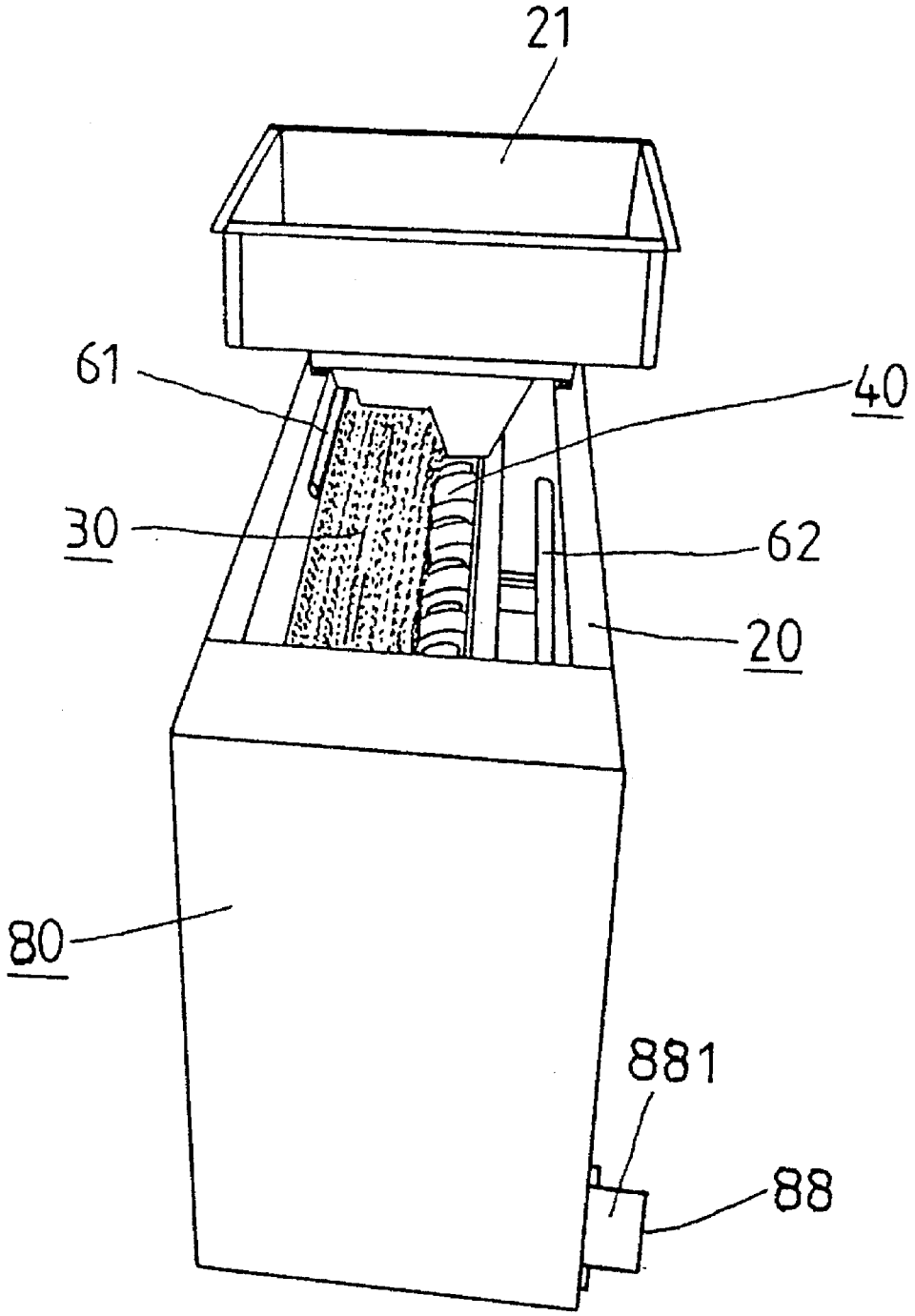
FIG. 2 shows a perspective view of a playball cleansing machine of the present invention.
Figure 3:
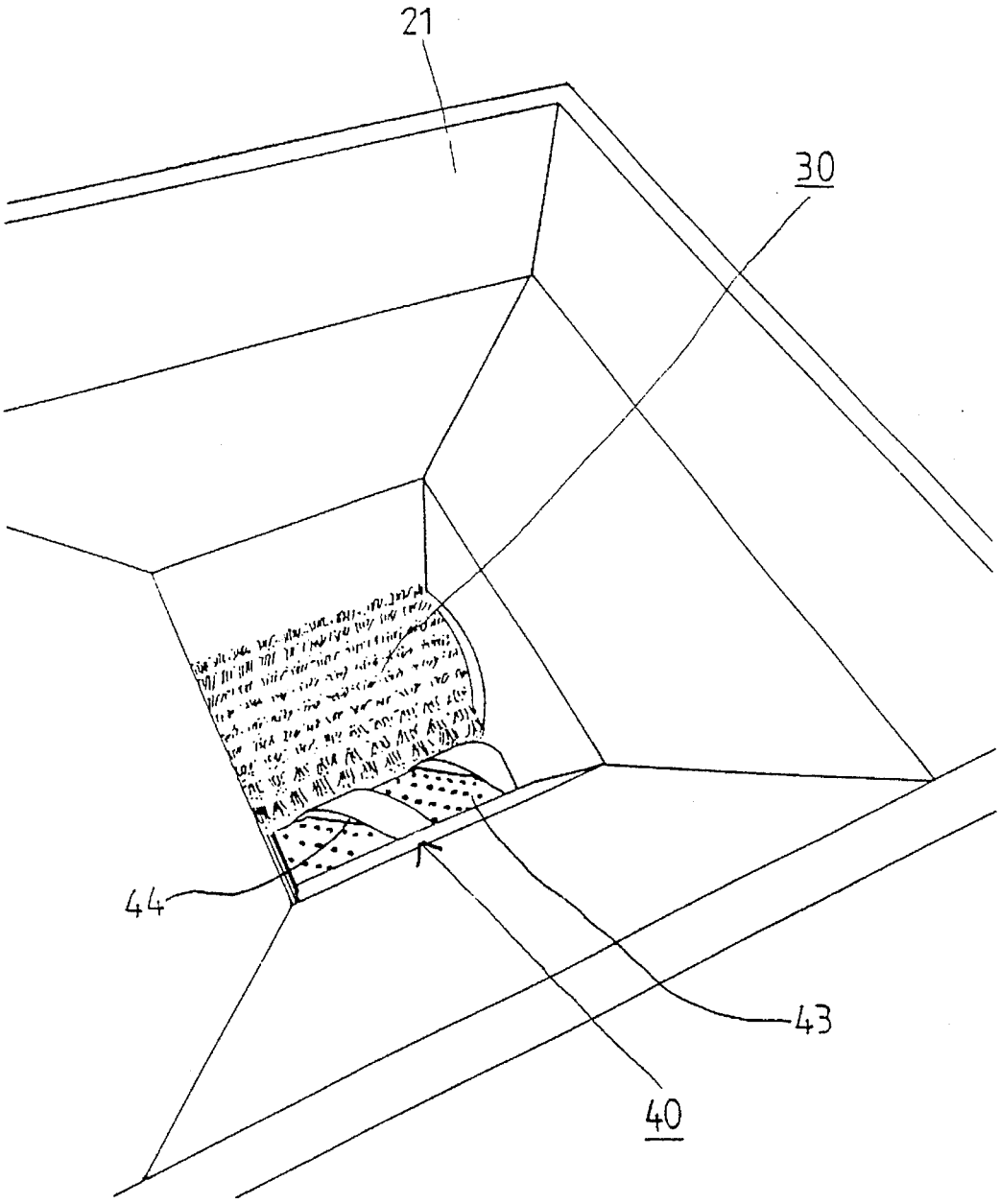
FIG. 3 shows a top view of a ball feeding frame of the present invention.
Figure 4:
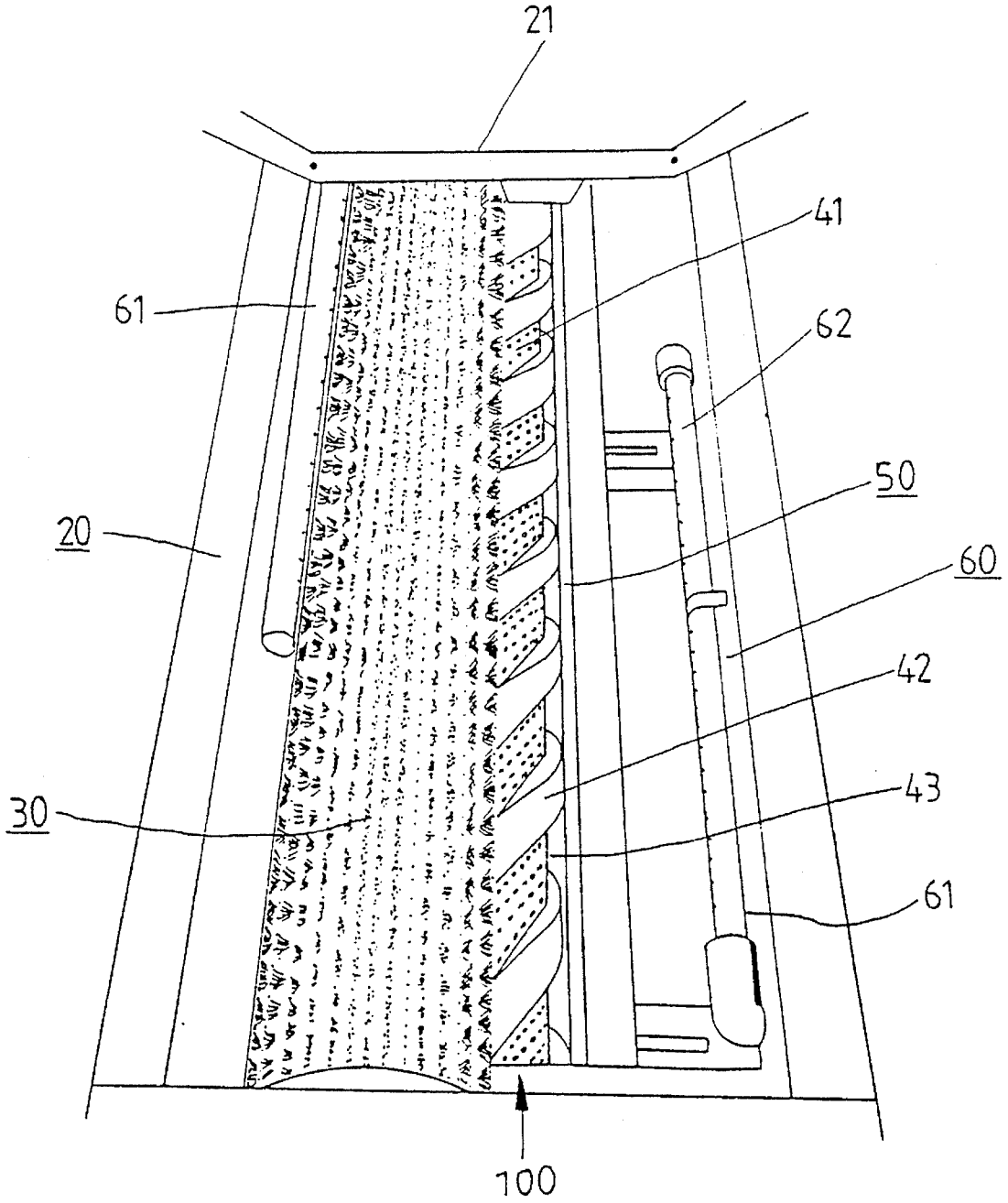
FIG. 4 shows a partial top view of the playball cleansing machine of the present invention.
Figure 5:
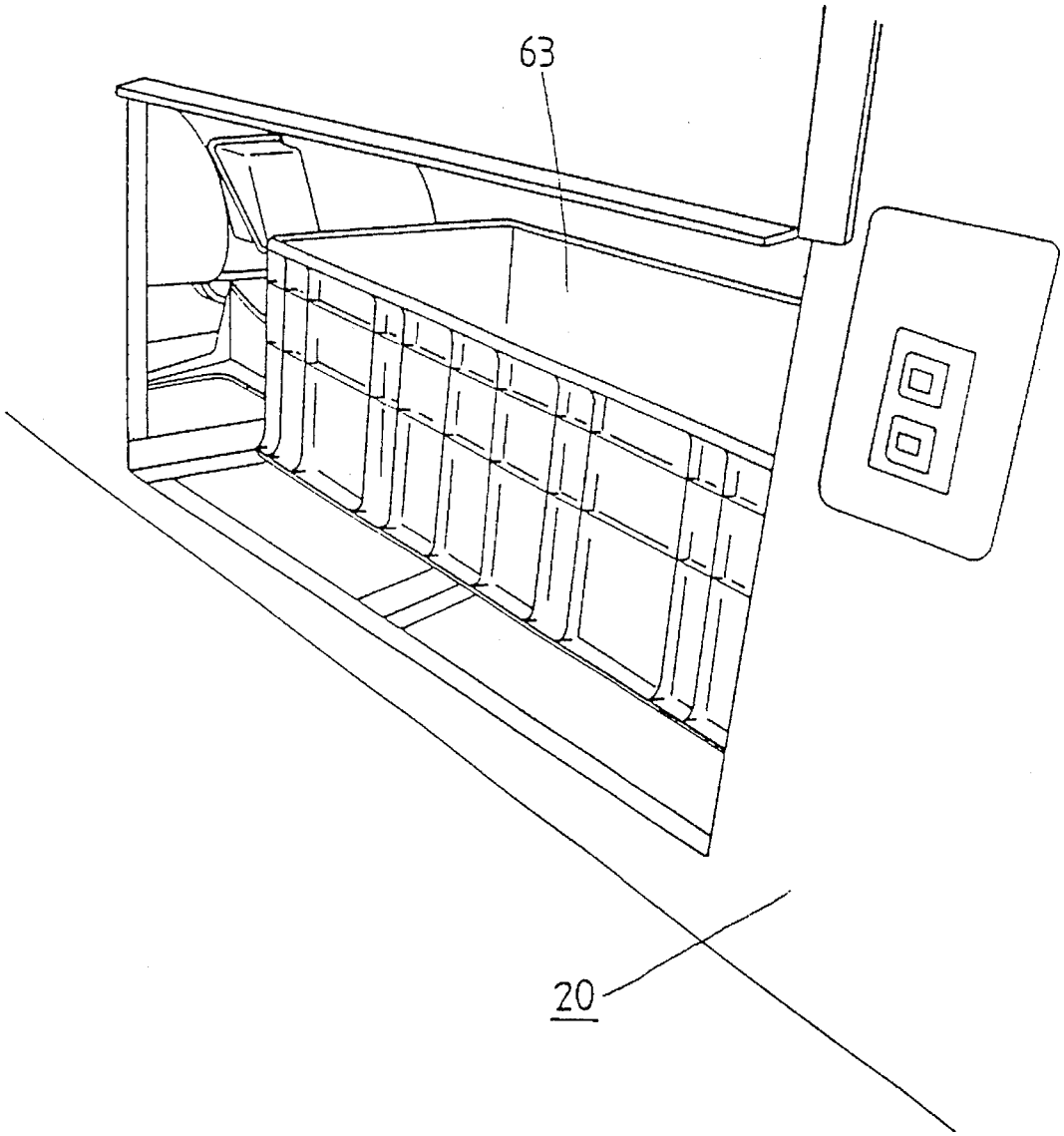
FIG. 5 shows a schematic view of a water tank of a water spraying unit of the present invention.
Figure 6:
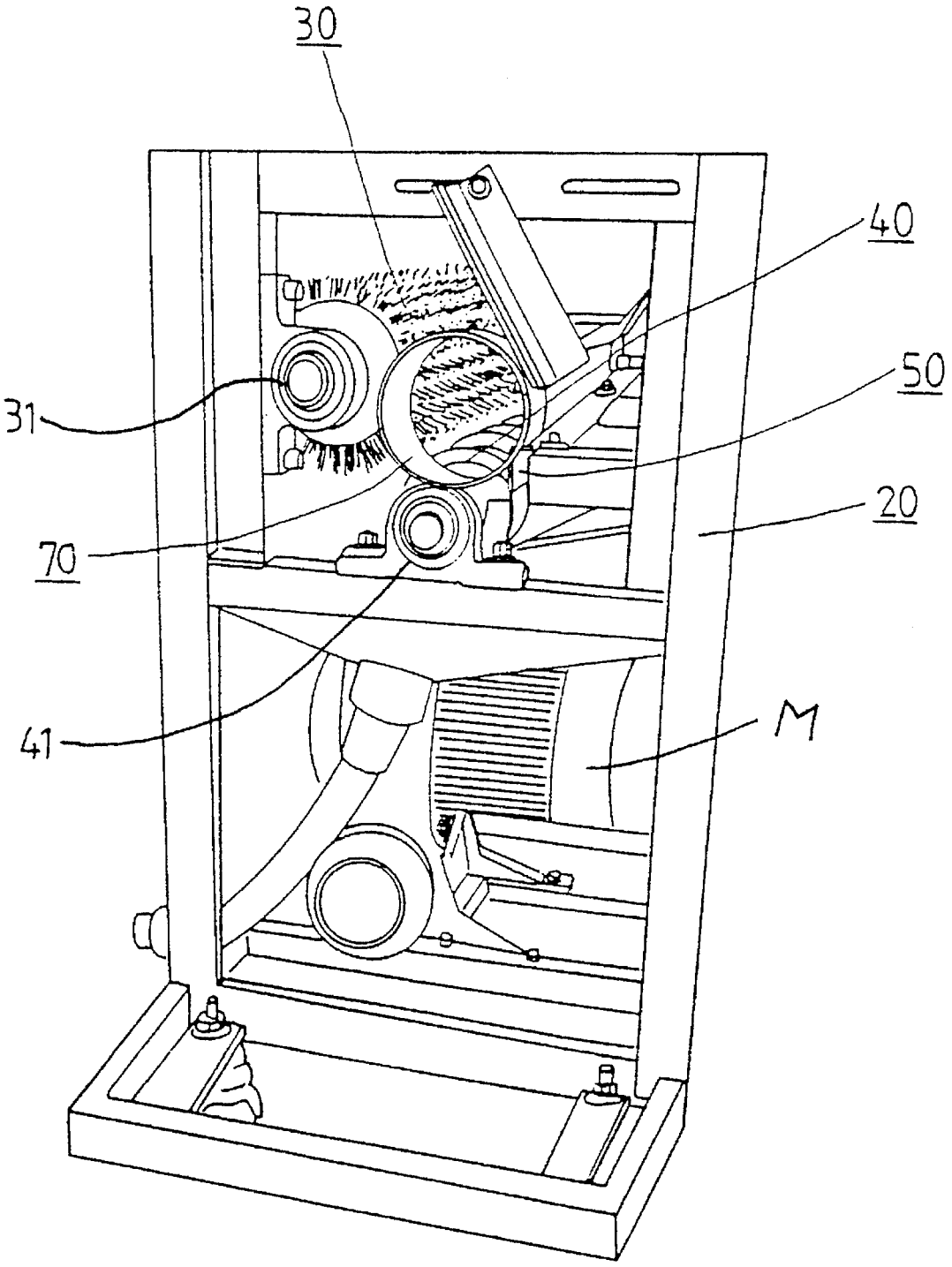
FIG. 6 shows a side view of a dismantled ball drying unit of the present invention.
Figure 7:
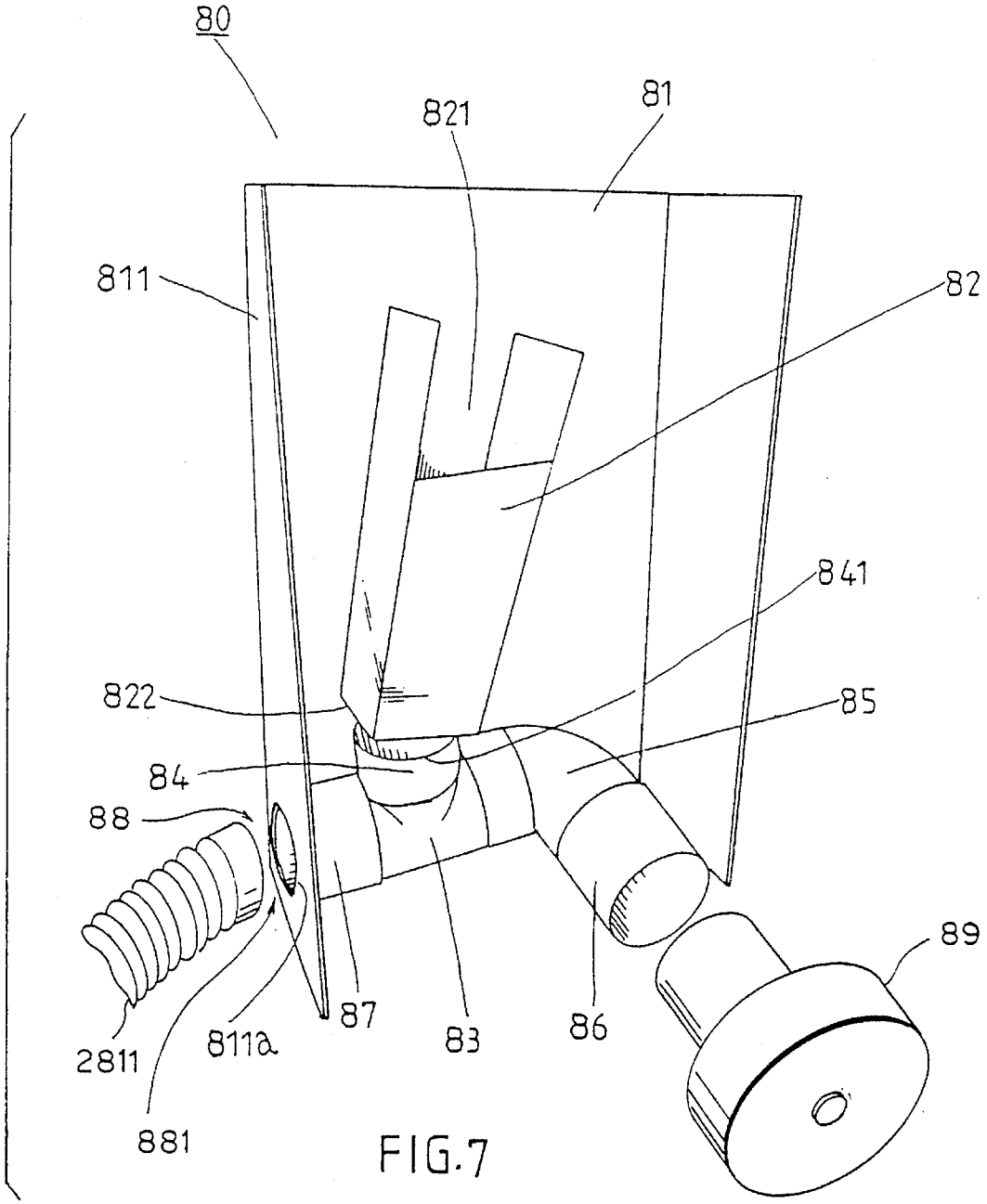
FIG. 7 shows a perspective view of the ball drying unit of the present invention, without showing the joint thereof.

As shown if FIGS. 2–9, the playball cleansing machine of the present invention comprises the component parts which are described explicitly hereinafter.

A housing 20 of a rectangular construction for receiving therein other component parts.

A ball feeding frame 21 is located at the rear end of the top of the housing 20 and is provided at the bottom thereof with an exit.

A transporting unit 100 is made up of a cleansing member 30, a transferring member 40, and a guide plate 50.

The cleansing member 30 has a shaft 31 which is fastened pivotally at both ends thereof with the housing 20 and is fastened at one end thereof with a motor m for driving the cleansing member 30. The shaft 31 is provided peripherally and radially with a plurality of bristles 32

The transferring member 40 has a shaft rod 41 located under one side of the cleansing member 30 such that the shaft rod 41 is parallel to the cleansing member 30. The shaft rod 41 is fastened pivotally at both ends thereof with the housing 20 and is fastened at one end thereof with a motor, or other power source. The shaft rod 41 is provided peripherally along the longitudinal axis thereof with a protruded spiral strip 42 for forming a spiral recessed rail 43.

The guide plate member 50 is located at one side of the transferring member 40 such that the guide plate member 50 is separated from the cleansing member 30 by a distance and is fastened at both ends thereof with the housing 20. The guide plate member 50 has a lower plate 51 having at the top thereof a shoulder plate 52 which is provided with an upper plate 53 extending upwardly.

A water spraying unit 60 comprises a first pipe member 61, a second pipe member 62, and a water tank 63. The first pipe member 61 is disposed by the front segment of the cleansing member 30 for spraying cleansing liquid. The second pipe member 62 is located at another side of the housing 20 such that the second pipe member 62 is near the middle and the rear segments of the transporting unit 100 for spraying water. The water tank 63 is located at the lower portion of the housing 20 for containing the cleansing liquid and is connected with the first pipe member 61 via which the cleansing liquid is sprayed a ball to be cleansed.

A ball discharging ring 70 is fastened at the front end of the transferring unit 40.

A ball drying unit comprises an outer casing 81, a guide member 82, a first guide tube 83, a second guide tube 84, a 90-degree elbow tube 85, a third guide tube 86, a fourth guide tube 87, and a joint 88. The guide member 82 is fastened to the inner wall of the casing 81 and is provided with an inlet 821 in alignment with the front end of the ball discharging ring 10. The guide member 82 is further provided with an outlet 822. The second guide tube 84 is disposed uprightly such that the lower segment of the second guide tube 84 is received in the first guide tube 83, and that the top of the second guide tube 84 is separated from the outlet 822 of the guide member 82 by a predetermined distance. The elbow tube 85 is fastened at the front end thereof with the rear end of the first guide tube 83. The third guide tube 86 is fastened at the front end thereof with the rear end of the elbow tube 85 and is fastened at the rear end thereof with an air compressor 89. The fourth guide tube 87 is fastened at the rear end thereof with the front end of the first guide tube 83 such that the front end of the fourth guide tube 87 is separated from the inner wall of a side plate 811 of the casing 81 by a predetermined distance. The joint 88 is fastened with the outer wall of the side plate 811 of the casing 81. The side plate 811 is provided with a round hole 811*a* in alignment with the inner end of the joint 88 and the front end of the fourth guide tube 87. The joint 88 has an outer end 881 which can be fastened with a flexible tube 2811 extending to reach a collection site of the soft vacuum playballs.

Figure 8:
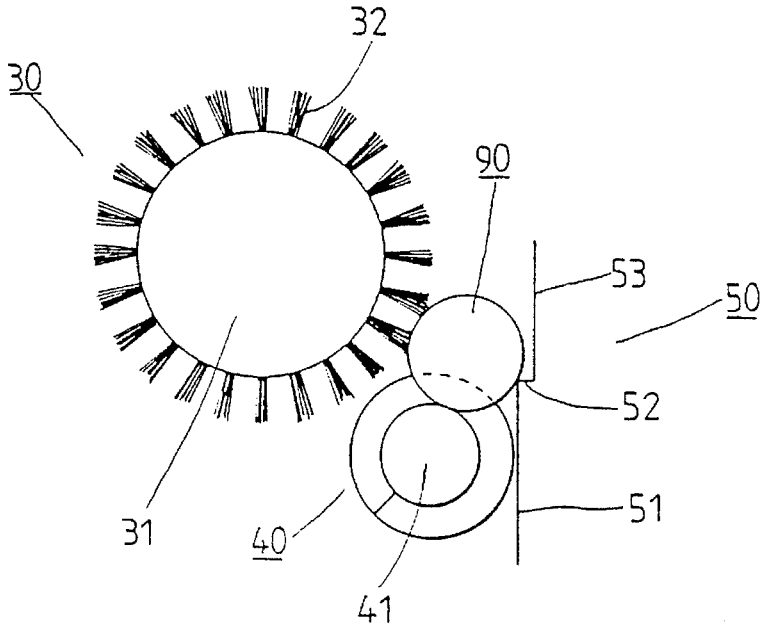
FIGS. 8 and 9 are schematic views of the present invention at work.
Figure 9:
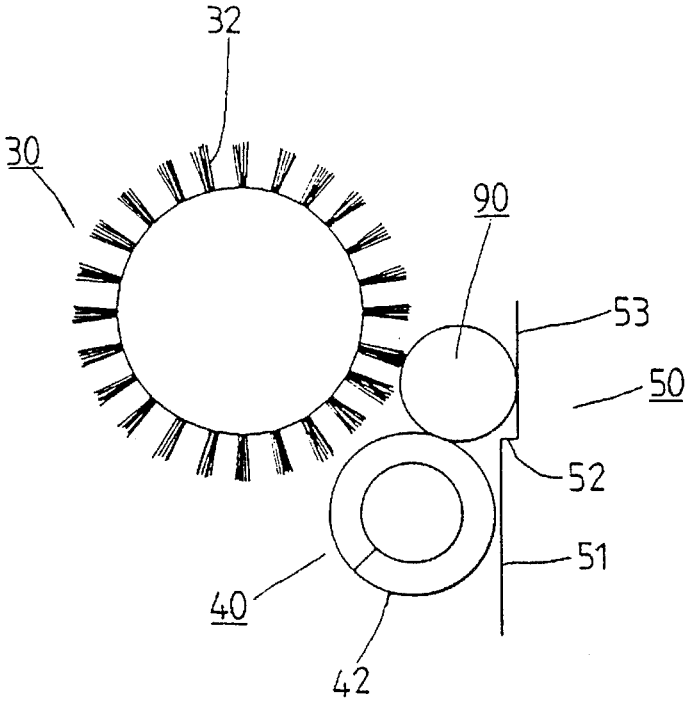

In operation, a playball intended to be cleansed is fed via the exit located at the bottom of the ball feeding frame 21 onto the rear end of the transferring member 40 of the transporting unit 100. If the playball 90 is received in the recessed rail 43 of the transferring member 40, as shown in FIG. 8, the playball is cleansed by the cleansing member 30 at work. The playball 90 is actuated by the spiral rail 43 to rotate until such time when the playball 90 is caught by the bristles 32 of the cleansing member 30. The playball 90 is then pushed upwards, as shown in FIG. 8. The playball 90 is subsequently kept on the protruded strip 42 of the transferring member 40 such that the playball 90 is caused to move slightly outwards so as to make contact with the inner wall of the upper plate 53 of the guide plate member 50. Such a design as described above is intended to prevent the playball 90 from being pushed out of the track and from being forced downwards by the bristles 32 to move into the recessed rail 43 of the transferring member 40. The playball 90 is actuated by the cleansing member 30 to rotate. The playball 90 is transferred from the rear end to the front end of the transferring member 40 before being discharged from the ball discharging ring 70.

The discharged playball 90 is received by the guide member 82 of the drying unit 80 and subsequently by the first guide tube 83. The compressed air is introduced into the third guide tube 86 and the elbow tube 85 for blowing the playball 90 to pass through the fourth guide tube 87 and the joint 88 before the dry playball 90 is caught by a net via the flexible tube.

It must be added here that the playball 90 is cleansed effectively by the machine of the present invention by virtue of the fact that the playball 90 is kept rotating and moving up and down when the playball 90 is pushed forward by the transporting unit 100, and that the playball 90 can be therefore cleansed thoroughly by the cleansing member 30.

The embodiment of the present invention described above to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. A playball cleansing machine for playballs comprising:

a housing; said housing including a playball feeding means located at a top of said housing and provided at a bottom thereof with an exit for feeding the playballs into the housing;

a transporting unit; said transporting unit comprising:

a cleansing member disposed within said housing having a shaft driven by a power source, said cleansing member including peripherally and radially a plurality of bristles for scrubbing the playballs upon rotation of said cleansing member;

a transferring member including a rod which is parallel to said cleansing member and is driven by the power source, said rod having peripherally a protruded spiral strip located along a longitudinal axis thereof, the strip forming a recessed rail to transport the playballs along said cleansing member;

a guide plate member fastened at both ends thereof to said housing such that said guide plate member is disposed by one side of said transferring member and is separated from said cleansing member by a first predetermined distance, said guide plate member having a lower plate provided at a top thereof with a shoulder plate, said guide plate member further having an upper plate extending upwards from said shoulder plate to position the playballs relative to said transferring member and said cleansing member;

a water spraying unit comprising a first tube, a second tube, and a container within the housing, said first tube including means for spraying cleansing liquid within the housing, said second tube including means for spraying water within the housing, said container including means for keeping therein said cleansing liquid for cleaning the playballs and connected with said first tube; and a ball discharging ring fastened with a front end of said transferring member for discharging cleansed playballs from the housing.

2. The playball cleansing machine according to claim 1 further comprising a ball drying unit for drying the playballs and located adjacent said ball discharging ring for receiving the playballs therefrom, said ball drying unit comprising:

a casing;

a guide member fastened to an inner wall of said casing and including an inlet in alignment with a front end of said ball discharging ring, said guide member further including an outlet;

a first guide tube located under said guide member, said first guide tube provided at a top thereof with an upper guide tube hole corresponding in location to said outlet of said guide member;

a second guide tube having a lower segment received in said upper guide tube hole of said first guide tube, said second guide tube further including an upper segment with a top edge which is separated from said outlet of said guide member by a second predetermined distance;

an elbow tube fastened at an elbow tube front end thereof to a first guide tube rear end of said first guide tube;

a third guide tube fastened at a third guide tube front end thereof to an elbow tube rear end of said elbow tube and at a third guide tube rear end thereof to an air compressor;

a fourth guide tube fastened at a rear end thereof to a first guide tube front end of said first guide tube such that a front end of said fourth guide tube is separated from an inner wall of a side plate of said casing by a third predetermined distance; and a joint fastened to an outer wall of said side plate of said casing such that an inner end of said joint and said front end of said fourth guide tube are aligned with a round hole of said side plate of said casing, and that an outer end of said joint is fastened to a flexible tube having a flexible tube end that is located at a ball collecting site.

* * * * *